US005479560A

United States Patent [19]

Mekata

[11] Patent Number: 5,479,560

[45] Date of Patent: Dec. 26, 1995

[54] FORMANT DETECTING DEVICE AND SPEECH PROCESSING APPARATUS

[75] Inventor: Tsuyoshi Mekata, Katano, Japan

[73] Assignee: Technology Research Association of Medical and Welfare Apparatus, Tokyo, Japan

[21] Appl. No.: 143,932

[22] Filed: Oct. 27, 1993

[30] Foreign Application Priority Data

Oct. 30, 1992 [JP] Japan ..... 4-292455

[51] Int. Cl.[6] ..... G10L 9/04

[52] U.S. Cl. ..... 395/2.18; 395/2.35; 395/2.37

[58] Field of Search ..... 395/2.18, 2.35, 395/2.36, 2.37, 2.8; 381/39

[56] References Cited

U.S. PATENT DOCUMENTS

| | | | |
|---|---|---|---|
| 4,186,280 | 1/1980 | Geiseler | 179/100.1 |
| 4,490,839 | 12/1984 | Bunge | 381/47 |
| 4,617,676 | 10/1986 | Jayant et al. | 375/27 |
| 4,642,782 | 2/1987 | Kemper et al. | 364/550 |
| 4,644,479 | 2/1987 | Kemper et al. | 364/550 |
| 4,649,515 | 3/1987 | Thompson et al. | 364/900 |
| 4,953,216 | 8/1990 | Beer | 381/68.4 |
| 5,018,075 | 5/1991 | Ryan et al. | 364/513 |
| 5,133,013 | 7/1992 | Munday | 381/47 |
| 5,161,158 | 11/1992 | Chakravarty et al. | 371/15.1 |
| 5,388,185 | 2/1995 | Terry et al. | 395/2.14 |

FOREIGN PATENT DOCUMENTS 3223798 10/1991 Japan .

OTHER PUBLICATIONS

Chemical Plant Fault Diagnosis Using Expert System Technology; Rowan; IFAC; Kyoto, Japan; Sep./Oct. 1986.

Expert Systems in On–Line Process Control; Moore et al.; Expert Systems in Process Control; pp. 839–867; Jul. 6, 1987.

A Continuous Real–Time Expert System for Computer Operations; Ennis et al; pp. 14–27; IBM J. Res. Develop. vol. 30, No. 1; Jan. 1986.

Kabal et al, "Adaptive Posifiltering for Enhancement of Noisy Speech in the Frequency Domain", Circuits & Systems, 1991 IEEE Int'l Symposium Apr. 1991 pp. 312–315.

Sangwine, S. J., "Fault Diagnosis in Combinational digital Circuits Using a Backtrack Algorithm to Generate Fault Location Hypotheses", IEE Proceedings, vol. 135(6), Dec. 1988, 247–252.

Simpson et al, Acta Otolaryngol (Stockh) 1990, Suppl. 469, pp. 101–107, "Spectral Enhancement to Improve the Intelligibility of Speech in Noise for Hearing–Impaired Listeners".

Cheng et al, *IEEE Transactions on Signal Processing,* vol. 39, No. 9, Sep. 1991, pp. 1943–1954, "Speech Enhancement Based Conceptually on Auditory Evidence".

*Primary Examiner*—Allen R. MacDonald
*Assistant Examiner*—Thomas J. Onka
*Attorney, Agent, or Firm*—Renner, Otto, Boisselle & Sklar

[57] ABSTRACT

A speech processing apparatus for obtaining a processed speech which is natural and comfortable for a listener, by refining a gain value assigned for each frequency band in enhancing formants in a power spectrum. The power spectrum, calculated in a frequency analyzing unit, is subject to contrast enhancement in a contrast enhancing unit, and judged as to whether it is a format or not in each frequency band. In a gain value assigning unit, a gain value of 1 is assigned to a formant, and a gain value smaller than 1 is to a frequency other than formant. A threshold value for each frequency band is determined by a threshold value determining unit in accordance with power spectrum of input speech signal, to eliminate the effect of variation in speech level.

14 Claims, 3 Drawing Sheets

FORMANT DETECTING DEVICE AND SPEECH PROCESSING APPARATUS

BACKGROUND OF THE INVENTION

1. Field of the Invention

The present invention relates to a formant detecting device for detecting a formant from an input speech signal and more particularly to a speech processing apparatus for enhancing frequency components in important frequency bands selected from a plurality of frequency bands included in the input speech signal.

2. Description of the Related Art

Normally, voiced speech contains a plurality of phonemes. In the spectrum analysis of a speech wave, each phoneme is characterized by several frequency bands on which energy concentrates. In the power spectrum of a speech signal, a frequency band of spectral peaks wall be called a formant hereinafter in this specification. In the human auditory system, a frequency analysis of speech is performed In the cochlea and auditory nerve of the internal ear to obtain a distribution of formants, which is used as a clue for specifying a phoneme. However, in the case of hearing-impaired listeners, since their ability of distinguishing one utterance from another when simultaneously hearing a plurality of utterances with different frequencies is reduced (a decline of frequency selectivity) compared with normal listeners, they often have difficulty In perceiving a formant. Also, when a noise can obscure speech, even the frequency selectivity of normal listeners is reduced due to the masking effect caused by the noise.

A formant enhancing device is known as a device which improves articulation of speech for the above-mentioned listeners with their frequency selectivity reduced.

Acta Otoraryngol 1990; Suppl. 469: pp. 101–107 discloses a conventional formant enhancing device.

FIG. 7 shows a construction of such a formant enhancing device, which has a frequency analyzing unit 10, a contrast enhancing unit 20 and an inverse transformation unit 30. The frequency analyzing unit 10 calculates a power spectrum and the phase of the input speech signal in each frequency band. This processing is realized via FFT, for instance. The contrast enhancing unit 20 enhances contrasts between peaks and valleys in the power spectrum which is obtained by the frequency analyzing unit 10. The contrast enhancing unit 20 enhances the difference in energy between spectral valleys and spectral peaks in the power spectrum of the input speech signal. In this specification, a power spectrum obtained in this way will be called a contrast-enhanced power spectrum, hereinafter. As a method for enhancing contrast, it is available as a method of convoluting a power spectrum with a function of lateral inhibition combined with an error function by using an engineering model for lateral inhibition (Equation 1).

$$w(x) = ke*err(-x^2/2de^2) - ki*err(-x^2/2di^2) \qquad \text{Equation1}$$

where ke>ki, de<di

There are other methods, such as powering each frequency component of the power spectrum, and multiplying the power spectrum by a smoothed out power spectrum obtained by cepstral analysis.

The inverse transformation unit 30 performs inverse transformation of the contrast-enhanced power spectrum, with its contrasts enhanced by the contrast enhancing unit 20, and the phase obtained by the frequency analyzing unit 10 into a speech signal as a function of time. For example, the inverse transformation unit 30 conducts inverse FFT so as to obtain a speech signal. In this case, in order to improve the naturalness of the speech, the frequency analyzing unit 10 performs a frequency analysis at intervals shorter than one frame of FFT, and the inverse transformation unit 30 generally performs an overlap-addition, i.e., a weighted-summation of immediately neighboring frames.

Hereinafter, the operation of a conventional formant enhancing device employing the above-mentioned construction will be explained. The frequency analyzing unit 10 calculates the power spectrum and the phase of input speech signal. The contrast enhancing unit 20 increases frequency components of spectral peaks in the power spectrum and decreases frequency components of spectral valleys in the power spectrum. The frequency band of spectral peaks corresponds to a formant. The inverse transformation unit 30 performs inverse transformation of the contrast-enhanced power spectrum and the phase of the input speech signal into a speech signal in time sequence. Thus, a speech signal easily audible even to hearing-impaired listeners can be obtained.

IEEE Trans. SP vol. 39, No. 9, pp. 1943–1954 discloses other conventional formant enhancing devices.

FIG. 8 shows a construction of such a formant enhancing device. In FIG. 8, the same components as those in FIG. 7 are denoted by the same reference numerals as those in FIG. 7, and the description thereof is omitted. In a divider 110, the contrast-enhanced power spectrum, obtained by the contrast enhancing unit 20, is divided by the power spectrum obtained by the frequency analyzing unit 10. In this way, the power spectrum is normalized, and a value of gain for each frequency band (referred to as a gain value hereinafter) is determined. A frequency characteristics variable filter 120 varies frequency characteristics of the input speech signal in accordance with the value of gain determined by the divider 110. In the case where the frequency analyzing unit 10 calculates a power spectrum every several sampling intervals, the output of the divider 110 is subject to an interpolative processing, and thereby naturalness of speech is improved.

A speech signal audible even to hearing-impaired listeners can be obtained also by formant enhancing devices according to the above-mentioned construction.

However, the formant enhancing devices shown in FIGS. 7 and 8 have a problem that the naturalness of speech is reduced, since a relationship of energy level among frequency components of spectral peaks in the contrast-enhanced power spectrum changes greatly from that in the power spectrum of the original speech signal.

Also, in a case where the engineering model for lateral inhibition is applied to the formant enhancing devices shown in FIGS. 7 and 8 so as to enhance contrasts, the level of the output speech signal from the formant enhancing device depends on the function of lateral inhibition to be convoluted in the power spectrum of the input speech signal, thus becoming excessively high or low. Accordingly, the output signal having a proper level cannot be obtained.

Further, in the formant enhancing devices shown in FIGS. 7 and 8, for the purpose of adjusting the extent to which a contrast is enhanced, it is required to change the function of lateral inhibition. This causes a difficulty in adjusting the extent. In the case where the extent to which a contrast is enhanced is adjusted to obtain a high contrast, if a speech signal overlapped with a background noise is input, the contrast between peaks and valleys in the power spectrum of the noise is enhanced. In this way, the noise is modulated, reducing the naturalness of speech as a result.

SUMMARY OF THE INVENTION

The formant detecting device of the present invention includes:

a frequency analyzing unit for calculating a power spectrum for an input speech signal;

a contrast enhancing unit for enhancing the contrast between a local maximum portion and a local minimum portion in the power spectrum of the input speech signal; and a threshold value judging unit for comparing the power in the power spectrum enhanced by the contrast enhancing unit with a threshold value in each frequency band and for judging a frequency band corresponding to the power to be a formant if the power in the contrast-enhanced power spectrum exceeds the threshold value.

According to another aspect of the present invention, the formant detecting device includes:

a frequency analyzing unit for calculating a power spectrum of an input speech signal;

a contrast enhancing unit for enhancing the contrast between a local maximum portion and a local minimum portion in the power spectrum of the input speech signal;

a dividing unit for dividing the power spectrum enhanced by the contrast enhancing unit by power spectrum of the input speech signal in each frequency band; and a threshold value judging unit for comparing a divisional result obtained by the dividing unit with a threshold value in each frequency band and for judging a frequency band corresponding to the divisional result to be a formant if the divisional result exceeds the threshold value.

In one embodiment of the invention, the threshold value is predetermined so that first and second formants of each of five vowels vocalized by a specific speaker are detected by the formant detecting device with probability of 50% or more.

In another embodiment of the invention, the formant detecting device further includes a threshold determining unit for determining the threshold value in accordance with the power spectrum of the input speech signal.

In another embodiment of the invention, the threshold value determining unit determines the threshold value in each frequency band so that the threshold value is equal to a product of a constant and a frequency component in the power spectrum of the input speech signal.

In another embodiment of the invention, the threshold value determining unit determines the threshold value so that the threshold value is equal to an average value of frequency components over all the frequency bands in the power spectrum of the input speech signal.

In another embodiment of the invention, the formant detecting device further includes a constant changing unit for changing the constant manually.

In another embodiment of the invention, a formant detecting device further includes a constant changing unit for receiving a background noise level and for changing the constant in accordance with the background noise level.

According to another aspect of the invention, a speech processing apparatus includes:

a frequency analyzing unit for calculating a power spectrum of an input speech signal;

a contrast enhancing unit for enhancing the contrast between a local maximum portion and a local minimum portion in the power spectrum of the input speech signal;

a threshold value judging unit for comparing the power in the power spectrum enhanced by the contrast enhancing unit with a threshold value in each frequency band and for judging a frequency band corresponding to the power to be a formant if the power in the contrast-enhanced power spectrum exceeds the threshold value;

a gain value assigning unit for assigning a first gain value to the frequency band judged to be a formant by the threshold judging unit and for assigning a second gain value to other frequency bands; and a speech signal generating unit for generating a speech signal having a power spectrum obtained by multiplying the power spectrum of the input speech signal with the first gain value or the second gain value assigned by the gain value assigning unit in each frequency band.

According to another aspect of the invention, the speech processing apparatus includes:

a frequency analyzing unit for calculating a power spectrum of an input speech signal;

a contrast enhancing unit for enhancing the contrast between a local maximum portion and a local minimum portion in the power spectrum of the input speech signal;

a dividing unit for dividing the power spectrum enhanced by the contrast enhancing unit by the power spectrum of the input speech signal in each frequency band;

a threshold value judging unit for comparing a divisional result obtained by the dividing unit with a threshold value in each frequency band and for judging a frequency band corresponding to the divisional result to be a formant if the divisional result exceeds the threshold value;

a gain value assigning unit for assigning a first gain value to the frequency band judged to be a formant by the threshold judging unit and for assigning a second gain value to other frequency bands; and a speech signal generating unit for generating a speech signal having a power spectrum obtained by multiplying the power spectrum of the input speech signal by the first gain value or the second gain value assigned by the gain value assigning unit in each frequency band.

In one embodiment of the invention, in the speech processing apparatus, the frequency analyzing unit further calculates a phase of the input speech signal, and the speech signal generating unit further includes:

a multiplying unit for multiplying the power spectrum of the input speech signal with the first gain value or the second gain value assigned by the gain value assigning unit in each frequency band; and an inverse transformation unit for transforming inversely a multiplicative result obtained by the multiplying unit and the phase of the input speech signal obtained by the frequency analyzing unit into the speech signal.

In another embodiment of the invention, in the speech processing apparatus, the speech signal generating unit includes frequency characteristics variable filter unit for varying frequency characteristics of the input speech signal in accordance with the first gain value or the second gain value assigned by the gain value assigning unit.

In another embodiment of the invention, in the speech processing apparatus, the gain value assigning unit has a plurality of candidate values for at least one of the first end second gain values, and the speech processing unit further includes a gain value switching unit for switching at least one of the first and second gain values to one of the plurality of candidate values.

In another embodiment of the invention, in the speech processing unit, the gain value assigning unit has a plurality of candidate values for at least one of the first and second gain values, and the speech processing unit further includes:

a background noise level detecting unit for detecting a background noise level from the input speech signal; and a gain value switching unit for switching at least one of the first and second gain values to one of the plurality of candidate values.

Thus, the invention described herein makes possible the advantages of (1) providing a speech processing apparatus in which contrasts in energy between formants and other frequency bands is increased in such a manner that a relationship in energy level among a plurality of formants existing simultaneously is the same as in the original speech, whereby the naturalness of voiced speech is preserved; (2) providing a speech processing apparatus in which the output signal level does not become too high or too low depending on parameters of a lateral inhibition function, even if using an engineering model for lateral inhibition in order to enhance the contrast; (3) providing a speech processing apparatus in which the extent of contrast enhancement is adjustable easily, by changing the extent in accordance with noise or the like, for preventing a deterioration of naturalness of speech; and (4) providing a speech processing apparatus which can dispense with a divider.

These and other advantages of the present invention will become apparent to those skilled in the art upon reading and understanding the following detailed description with reference to the accompanying figures.

DESCRIPTION OF THE PREFERRED EMBODIMENTS

The present invention will be described hereinafter with reference to the accompanying drawings.

Figure 1:
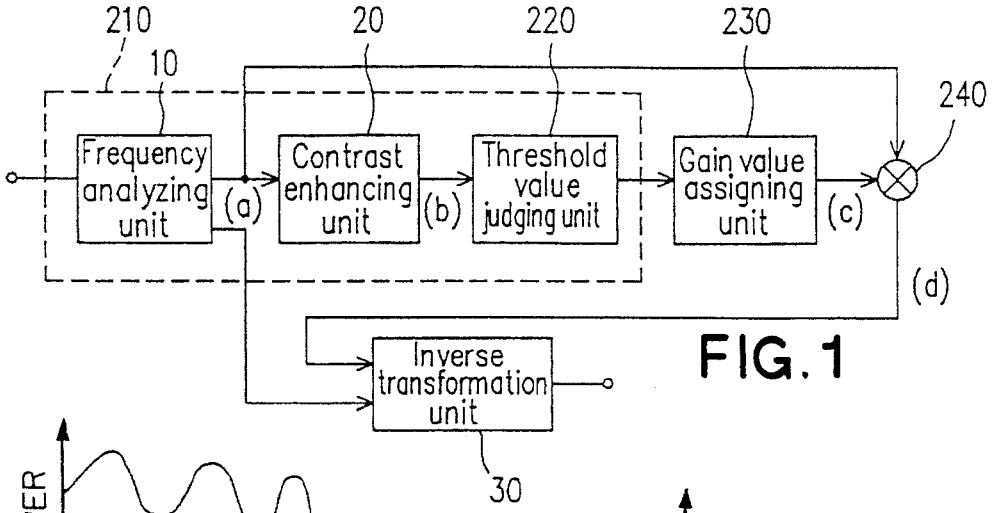
FIG. 1 is a block diagram of a speech processing apparatus of the first embodiment according to the present invention.
Figure 7:
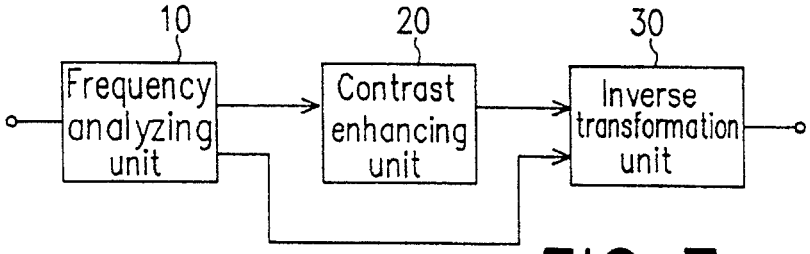
FIG. 7 PRIOR ART
FIG. 7 is a block diagram of a conventional formant enhancing device.
Figure 8:
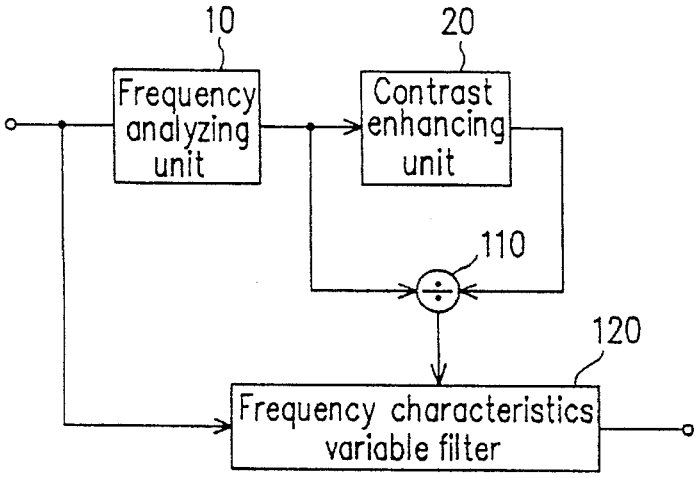
FIG. 8 PRIOR ART
FIG. 8 is a block diagram of a conventional formant enhancing device.

FIG. 1 shows a construction for a speech processing apparatus according to the first embodiment of the present invention. In FIG. 1, the same components as those in FIGS. 7 and 8 are denoted by the same reference numerals as those in FIGS. 7 and 8.

The speech processing apparatus has a formant detecting device 210 for detecting a formant from an input speech signal. The formant detecting device 210 includes a frequency analyzing unit 10, a contrast enhancing unit 20 and a threshold value judging unit 220.

The frequency analyzing unit 10 calculates a power spectrum and a phase for the input speech signal. The contrast enhancing unit 20 receives the power spectrum obtained by the frequency analyzing unit 10 and enhances contrasts between local maximum portions and local minimum portions, i.e., peaks and valleys in the power spectrum. On the basis of the power spectrum from the contrast enhancing unit 20, the threshold value judging unit 220 judges a specific frequency band to be a formant.

The speech processing apparatus is provided with a gain value assigning unit 230 which assigns a value of 1 to each of the formants detected by the formant detecting device 210 and a value of g ($0 \leqq g < 1$) to each of the frequency bands other than the formants, as a value of the gain (referred to as a gain value hereinafter), and a multiplier 240 which multiplies the power spectrum of the input speech signal by the gain assigned by the gain value assigning unit 230. An inverse transformation unit 30 performs inverse transformation, based on the input speech signal multiplied by the multiplier 240 and the phase of the input speech signal, so as to generate a time series speech signal.

The operation of the speech processing apparatus will be described. The frequency analyzing unit 10 accepts the input speech signal and calculates therefrom a power spectrum and a phase for the input speech signal. The contrast enhancing unit 20 enhances contrasts in the power spectrum obtained by the frequency analyzing unit 10. In other words, powers of spectral peaks in the power spectrum are increased and the powers of valleys in the power spectrum are decreased. In the threshold value judging unit 220, a threshold value is preset so that only the power of the peak in the power spectrum exceeds the threshold value. The method of determining such a threshold value will be described later. The threshold value judging unit 220 compares the contrast-enhanced power spectrum with the predetermined threshold value. If a power in the contrast-enhanced power spectrum exceeds the predetermined threshold value in a frequency band, the threshold value judging unit 220 judges this frequency band to be a formant.

Described in detail, assuming that f stands for a frequency band, E(f) for a frequency component of the contrast-enhanced power spectrum, T for a predetermined threshold value, the threshold value judging unit 220 judges the frequency band f which satisfies $E(f) > T$ to be a formant. A gain value assigning unit 230 assigns a gain value of 1 to a frequency band judged to be a formant end assigns a gain value of g ($0 \leqq g < 1$) to a frequency band which satisfies $E(f) \leqq T$. The multiplier 240 multiplies the power spectrum of the input speech signal by the gain assigned by the gain value assigning unit 230. Hereinafter, a power spectrum obtained in this way will be called a gain-adjusted spectrum.

The inverse transformation unit 30 receives the gain-adjusted power spectrum from the multiplier 240 and the phase of input speech signal, and converts them into a speech signal.

Figure 2A:
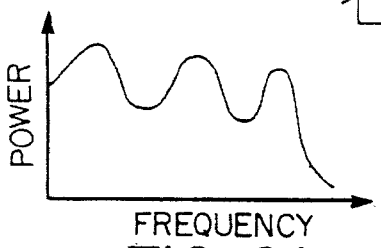
FIGS. 2A, 2B and 2D show examples of the power spectrum at points (e), (b) and (d), respectively, shown in FIG. 1.
Figure 2C:
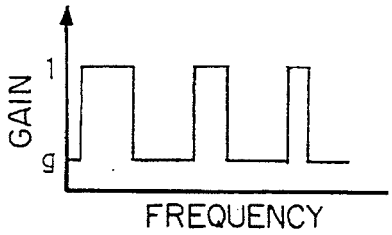
FIG. 2C shows an example of gain at a point (c) shown in FIG. 1.
Figure 2D:
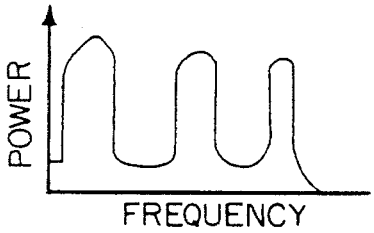
Figure 2B:
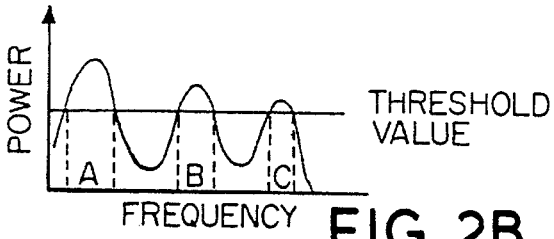

FIGS. 2A, 2B and 2D show examples of the power spectrum at three points respectively, (a), (b) and (d) in FIG. 1. FIG. 2C is an exemplary gain value at a point (c) in FIG. 1. In these examples, the frequency bands corresponding to three peaks whose powers exceed the threshold value in the power spectrum shown in FIG. 2B are judged to be formants A, B and C, respectively. Next, as shown in FIG. 2C, a gain value is assigned to each of the frequency bands in accordance with formants A, B and C. That is, a gain value of 1 is assigned to each of the formants A, B and C, and a gain value of g is assigned to each of other frequency bands. The power spectrum as shown in FIG. 2D is obtained by multiplying the power spectrum of input speech signal as shown in FIG. 2A by the assigned gain. The power spectrum shown in FIG. 2D is supplied to the inverse transformation unit 30.

The threshold value preset in the threshold value judging unit 220 will be explained hereinafter. This threshold value is obtained by the following steps (1) through (5).

(1) A speaker pronounces the five vowels of Japanese, i.e, "a", "i", "u", "e" and "o" at predetermined intervals.

(2) The first and second formants to be used as standards are obtained previously with respect to each of above five vowels, by using a conventional formant extraction method. The first formant means a formant with the lowest frequency, and the second formant means a formant with the second lowest frequency, higher than the first formant. For example, a peak-picking method or an A-b-s method can be used for this purpose, as a conventional formant extraction method.

(3) Each vowel is converted to a speech signal and input to the above-mentioned formant detecting device 210.

(4) The formant detecting device 210 adjusts the threshold value of the threshold value judging unit 220 so that both of the first and second formants to be used as standards are detected with probability of 50% or more. If describing in more detail, a value (initial value) firstly set in the threshold value judging unit 220 of the formant detecting device 210 is made relatively large. The smaller the value is, the larger becomes the probability that both second and first formants are detected. When making the value smaller gradually, if the probability both the first and second formants being detected exceeds 50%, the value is set in the threshold value judging unit 220 as a threshold value.

(5) A threshold value adjusted to satisfy the above (4) condition is determined to be a threshold value of the threshold value judging unit 220.

If the threshold value of the threshold value judging unit 220 is adjusted after the formant detecting device 210 is incorporated into the speech processing apparatus, the threshold value may be adjusted so that the monosyllabic articulation and intelligibility will be improved in the speech which has been processed by the speech processing apparatus.

Further, to obtain proper processed speech in accordance with various kinds of noisy speech, the speech processing apparatus may provide a threshold value changing unit for changing the threshold value adjusted in the above-mentioned manner. For example, the threshold value changing unit includes a switch for manually changing the threshold value set in the threshold value judging unit 220, and the set value is changed into another value by an operator's operation of the switch. Specifically, if the above threshold value is a value adjusted for speech without noise, this threshold value is preferably changed to a larger threshold value under noisy surroundings. In this way, the probability that a noise component exceeds the threshold value is lowered, and then the possibility of erroneous enhancement of the noise components is reduced.

In the speech processing apparatus according to the first embodiment of this invention, the contrast-enhanced power spectrum, an output from the contrast enhancing unit 20, is not supplied to the inverse transformation unit 30. Instead, a power spectrum obtained by multiplying each frequency component of the power spectrum of the input speech signal by a predetermined gain value of 1 or g is supplied to the inverse transformation unit 30, in accordance with detected formants. In this gain-adjusted power spectrum, the power of the peak is equal to that of the peak in the power spectrum of input speech signal. On the other hand, the power of the valley in the gain-adjusted power spectrum is decreased into a product of g and the power of the valley in the power spectrum of input speech signal. Accordingly, in the power spectrum to be supplied to the inverse transformation unit 30, the relationship of power among formants is substantially the same as that in the input speech signal. As a result, .there can be obtained a processed speech wherein contrasts of energy between formants and other frequency bands are increased. Further, because the gain value in each frequency band is 1 at maximum, even if the engineering model for lateral inhibition is applied to contrast enhancement, the output signal level is not rendered excessively high depending on parameters of the lateral inhibition function.

Figure 3:
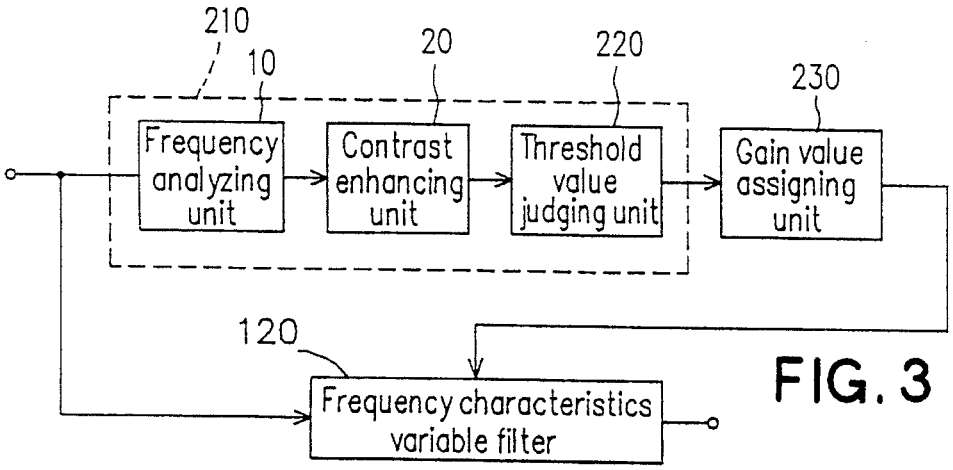
FIG. 3 is a block diagram of a speech processing apparatus of the second embodiment according to the present invention.

FIG. 3 shows a speech processing apparatus according to the second embodiment of the present invention. In FIG. 3, the same components as in FIGS. 1 and 8 are denoted by the same reference numerals as those in FIGS. 1 and 8. The speech processing apparatus includes the formant detecting device 210 for detecting a formant from an input speech signal. The speech processing apparatus further includes a gain value assigning unit 230 for assigning a gain value of 1 to each of the formants detected by the formant detecting device 210 and a gain value of g ($0 \leqq g < 1$) to each of the frequency bands other than formants, and a frequency characteristic variable filter 120 for varying frequency characteristics of the input speech signal in accordance with the obtained gain.

The operation of the speech processing apparatus will be described. The formant detecting device 210 detects a formant from an input speech signal. Since the construction of the formant detecting device 210 is the same as that of the first embodiment, the operation thereof is not described in detail here. The gain value assigning unit 230 determines a gain value for each frequency band in accordance with an output from the formant detecting device 210, and supplies determined gain values to the frequency characteristic variable filter 120. The gain value to be assigned is 1 for each of the formants, and g for other frequency bands. Accordingly, in the power spectrum obtained by the frequency characteristic variable filter 120, the power of the spectral peak corresponding to a formant is equal to the power of the spectral peak in the power spectrum of input speech signal, while the power of the spectral valley is decreased into a production of the gain value of g and the power of the spectral valley in the power spectrum of the input speech signal.

Thus, according to the speech processing apparatus according to the second embodiment of the present invention, in the power spectrum obtained by the frequency characteristic variable filter 120, the relationship among formants in terms of energy level is substantially the same as that in the input speech signal. As a result, a processed speech wherein contrasts of energy between formants and other frequency bands are increased is obtained, without degrading naturalness of speech. Further, since a gain value for each frequency band is 1 at maximum, even if the engineering model for lateral inhibition is applied to the contrast enhancement, the level of an output signal is not rendered excessively high depending on parameters of the function of lateral inhibition. Also, it becomes possible to dispense with the divider 110 of the conventional device shown in FIG. 8 and the multiplier 240 necessary in the speech processing apparatus shown in FIG. 1. This ensures reduction of many calculation steps, and thereby the time period required for calculation is largely shortened.

Figure 4:
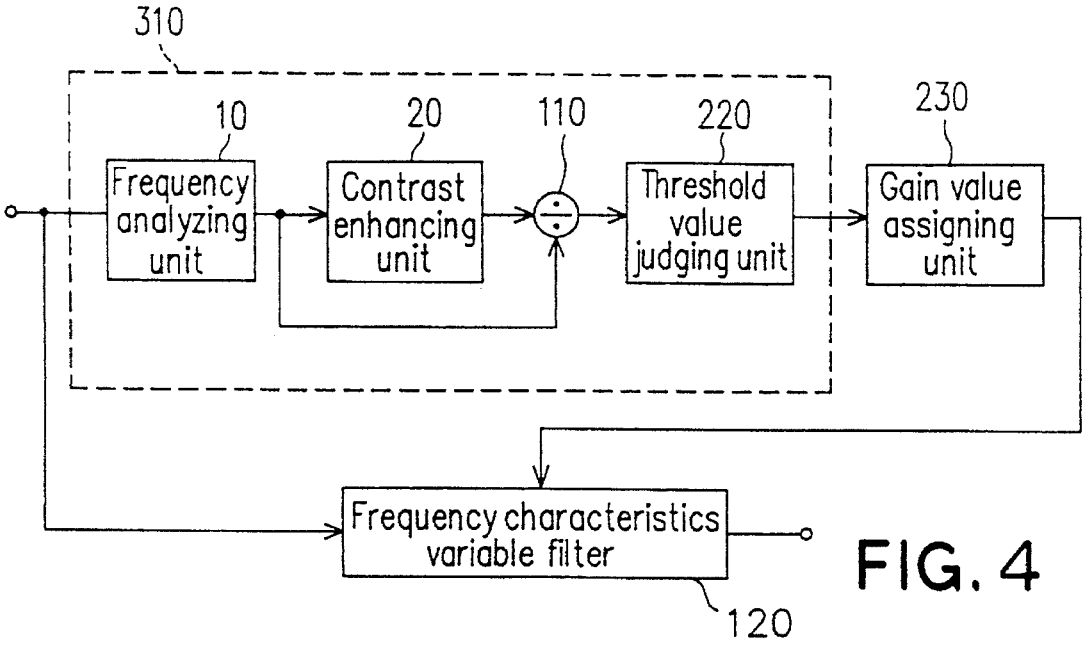
FIG. 4 is a block diagram of a speech processing apparatus of the third embodiment according to the present invention.

FIG. 4 shows a construction for a speech processing apparatus according to the third embodiment of the present invention. The same components as those in FIGS. 1 and 8 are denoted by the same reference numerals as those in FIGS. 1 and 8.

The speech processing apparatus has a formant detecting device 310 for detecting formants from an input speech signal. The formant detecting device 310 includes the frequency analyzing unit 10, the contrast enhancing unit 20 for enhancing contrasts between peaks and valleys in the power spectrum of the input speech signal, the divider 110 for dividing the contrast-enhanced power spectrum from the contrast enhancing unit 20 by the power spectrum of the input speech signal and the threshold value judging unit 220 for judging a specific frequency band to be a formant based on the divisional result obtained by the divider 110 and the threshold value. The speech processing apparatus further includes the gain value assigning unit 230 for assigning a gain value of 1 to each of the formants detected by the formant detecting device 310 and for assigning a gain value of g ($0 \leqq g < 1$) to each of the other frequency bands, and the frequency characteristics variable filter 120 for varying the frequency characteristics of input speech signal in accordance with the assigned gain values.

The operation of the speech processing apparatus will be explained hereinafter. The formant detecting device 310 detects formants from the input speech signal. In this formant detecting device 310, the power in each frequency band, that is, each frequency component of the power spectrum enhanced by the contrast enhancing unit 20, is divided by the corresponding power of the input speech signal. As a result, a normalized power spectrum for input speech signal is obtained, and this normalized spectrum is supplied to the threshold value judging unit 220, wherein the comparison between a predetermined threshold value and the normalized spectrum is carried out. The predetermined threshold value can be determined without depending on an average level of the input speech signal since the normalized power spectrum does not depend on the average level of the input speech signal. Accordingly, even in the case where a long-time average level of the input speech signal varies greatly, there is no need to change the predetermined threshold value. If the power in the normalized power spectrum exceeds the threshold value, the threshold value judging unit 220 judges a frequency band corresponding to the power to be a formant. An output from the formant detecting device 310 is supplied to the gain value assigning unit 230. The gain value assigning unit 230 and the frequency characteristics variable filter 120 are the same as in the second embodiment, the operation thereof is not described in detail here.

For those skilled in the art, it is apparent that the formant detecting device 210 according to the first embodiment is replaceable with the formant detecting device 310 according to the third embodiment.

According to the speech processing apparatus of the third embodiment of the present invention, similarly to the speech processing apparatus of the second embodiment, the relationship of energy levels among formants in the power spectrum of the resulting speech signal obtained by the frequency characteristics variable filter 120 is the same as that in the power spectrum of the input speech signal. As a result, without reducing naturalness of the speech, there can be obtained a processed speech having increased contrasts of energy between formants and other frequency bands. Since the gain value assigned to each frequency band is 1 at maximum, the output signal level does not rise up to an excessively high level depending on parameters of the function of lateral inhibition, even if applying an engineering model for lateral inhibition to contrast enhancement. In addition, there is no need to change the threshold value of the threshold value judging unit 220 in accordance with an average level of the input speech signal. Thus, the level of output signal is adjustable in conformity with the variation of the level of the input speech signal level.

Figure 5:
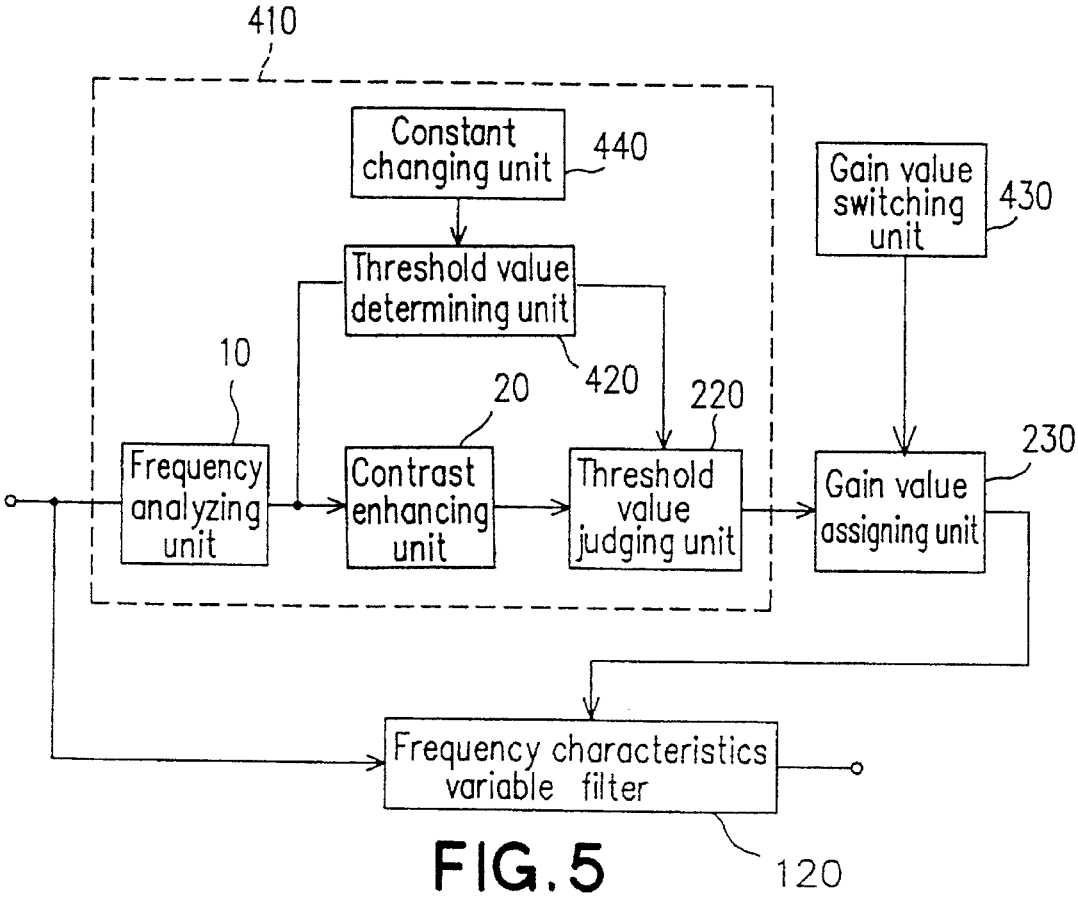
FIG. 5 is a block diagram of a speech processing apparatus of the fourth embodiment according to the present invention.

FIG. 5 shows a construction for a speech processing apparatus according to the fourth embodiment of the present invention. In FIG. 5, the same components as those FIGS. 1 and 8 are denoted by the same reference numerals as those in FIGS. 1 and 8.

The speech processing apparatus has a formant detecting device 410 for detecting formants from the input speech signal. The formant detecting device 410 has the components included in the above-mentioned formant detecting device 210, that is, the frequency analyzing unit 10, the contrast enhancing unit 20 end the threshold value judging unit 220. This formant detecting device 410 further includes a threshold value determining unit 420 for determining the threshold value of the threshold value judging unit 220. The threshold value determining unit 420 performs the multiplication of a constant and each frequency component of the power spectrum of the input speech signal, and sets the obtained value as a threshold value for each frequency band of the threshold value judging unit 220.

The setting of the threshold value by the threshold value determining unit 420 will be explained in detail hereinafter. It is assumed that f stands for a frequency band, P(f) for the power spectrum in the frequency band f of input speech signal and T(f) for a threshold value in the frequency band f. In this case, the threshold value determining unit 420 determines the threshold value T(f) for each frequency band so that $T(f) = \alpha P(f)$ is satisfied in each frequency band f, end sets the threshold value T(f) in the threshold value judging unit 220. Here, $\alpha$ is a predetermined constant. The method of obtaining this constant $\alpha$ will be described later. When E(f) stands for a frequency component of the contrast-enhanced power spectrum from the contrast enhancing unit 20 in the frequency band f, the threshold value judging unit 220 judges the frequency band f which satisfies $E(f) > T(f)$ $(= \alpha P(f))$ to be a formant.

In this way, the threshold value T(f) of the threshold value judging unit 220 is always in proportion to the corresponding frequency component in the power spectrum of the input speech signal. Therefore, even in the case where the long-time average level of the input speech signal varies greatly, the threshold value T(f) changes in conformity with the variation. This assures formant detection without depending on the long-time average level of input speech signal, similarly to the speech processing apparatus according to the third embodiment.

Alternatively, where $P_A$ stands for an average value of power over all the frequency bands in the input speech signal, the threshold value determining unit 420 may determine a threshold value T(f) for each frequency band f so that $T(f)=\alpha P_A$ is satisfied and set the threshold value T(f) in the threshold value judging unit 220. The threshold value determining unit 220 determines the frequency band f which satisfies the condition $E(f)>T(f)$ $(=\alpha P_A)$ to be a formant. Also in this case, it becomes possible to detect formants independently of the long-time average level of the input speech signal for the same reason as above mentioned.

Further, the method for determining the threshold value T(f) of the threshold value judging unit 220 in accordance with the input speech signal is not restrictive to the above method. Any other methods, as long as a threshold value is varied in accordance with rise or fall in the average energy or the power spectrum of input speech signal, can be used for determining the threshold value T(f).

In addition to the gain value assigning unit 230 and the frequency characteristics variable filter 120, the speech processing apparatus further includes a gain value switching unit 430. The gain value switching unit 430 stores a plurality of candidate values for a gain value of g to be assigned to the frequency bands other than formants, and switches the gain value of g by operating an external switch or the like. Thus, the gain value to be assigned to the frequency bands other than formants is made variable, which enables an operator to change easily the extent to which formants are enhanced. The operation of the gain value assigning unit 230 and the frequency characteristics variable filter 120 is not described in detail here, since it is the same as in the second embodiment.

For those skilled in the art, it will be apparent that the formant detecting device 210 of the first embodiment, and the formant detecting device 310 of the third embodiment, are respectively replaceable by the formant detecting device 410.

A constant α set by the threshold value determining unit 420 will be described. The constant α is obtained in accordance with the following steps (1) through (5).

(1) A speaker pronounces the five vowels of Japanese, i.e., "a", "i", "u", "e" and "o" at predetermined intervals.

(2) A first and a second formant to be used as references in each of the above five vowels are obtained previously, by using a conventional formant extraction method. The first formant means a formant with the lowest frequency, and the second formant means a formant with the second lowest frequency, higher than the first formant. For example, a peak-picking method or an A-b-s method is available as a conventional formant extraction method.

(3) Each vowel is converted to a speech signal and input to the above-mentioned formant detecting device 410.

(4) The formant detecting device 410 adjusts the value of the constant α so that both of the first and second formants obtained in the above (2) to be used as standards can be detected with probability of 50% or more in the power spectrum of input speech signal. If describing in more detail, the value of the constant α' (initial value) firstly set by the threshold value determining unit 420 is made relatively large. The smaller the value of the constant α' is, the larger the probability that both first and second formants are detected becomes. When reducing the value of the constant α' gradually, if the probability of both the first and second formants being detected exceeds 50%, the value of the constant α' is set in the threshold value judging unit 220 as the value of the constant α.

(5) The constant α, adjusted to satisfy the above condition (4), is set in the threshold value determining unit 420.

If the constant α in the threshold value determining unit 420 is adjusted after the formant detecting device 410 is incorporated in the speech processing apparatus, the constant α may be adjusted so that the monosyllabic articulation and intelligibility will be improved in the speech processed by the speech processing apparatus.

Further, to obtain a proper level of a processed speech under various circumstances, the speech processing apparatus may be provided with a constant changing unit 440 for changing the constant α adjusted in the above method. For example, the constant changing unit 440 includes a switch for changing the constant α manually, and the constant α set in the threshold value determining unit 420 is changed manually into another value by use of the switch. Specifically, assuming that the above constant α is a value adjusted without noise interference, it is preferable to change this constant into a larger constant β. Thus, there is reduced probability of the noise components exceeding the threshold value, whereby the possibility of enhancing noise components erroneously is reduced.

According to the speech processing apparatus of the fourth embodiment of the present invention, similarly to the speech processing apparatus of the second embodiment, the relationship of the energy levels among formants in the power spectrum of the speech signal obtained by the frequency characteristics variable filter 120 is substantially the same as that of the input speech signal. As a result, without reducing naturalness of the speech, a processed speech having increased contrasts of energy between formants and other frequency bands is obtained. Further, by changing the threshold value in accordance with the power spectrum of the input speech signal, it becomes possible to change the threshold value in accordance with a variation of the input speech signal level.

In addition, since the gain value switching unit 430 is provided, it becomes possible to change the extent of enhancing formants, in accordance with the extent to which the listener's frequency selectivity is degraded. This facilitates obtaining a proper extent of formant enhancement in consideration of the difference among individual listeners, and assures changing the extent of formant enhancement in accordance with background noises. The occurrence of unnatural remaining noises caused by modulation of noises is reduced in this way. Further, since the divider 110 required in the speech processing apparatus shown in FIG. 4 is unnecessary, it is possible to dispense with many calculation steps. As a result, the time length required for calculation is largely shortened.

Figure 6:
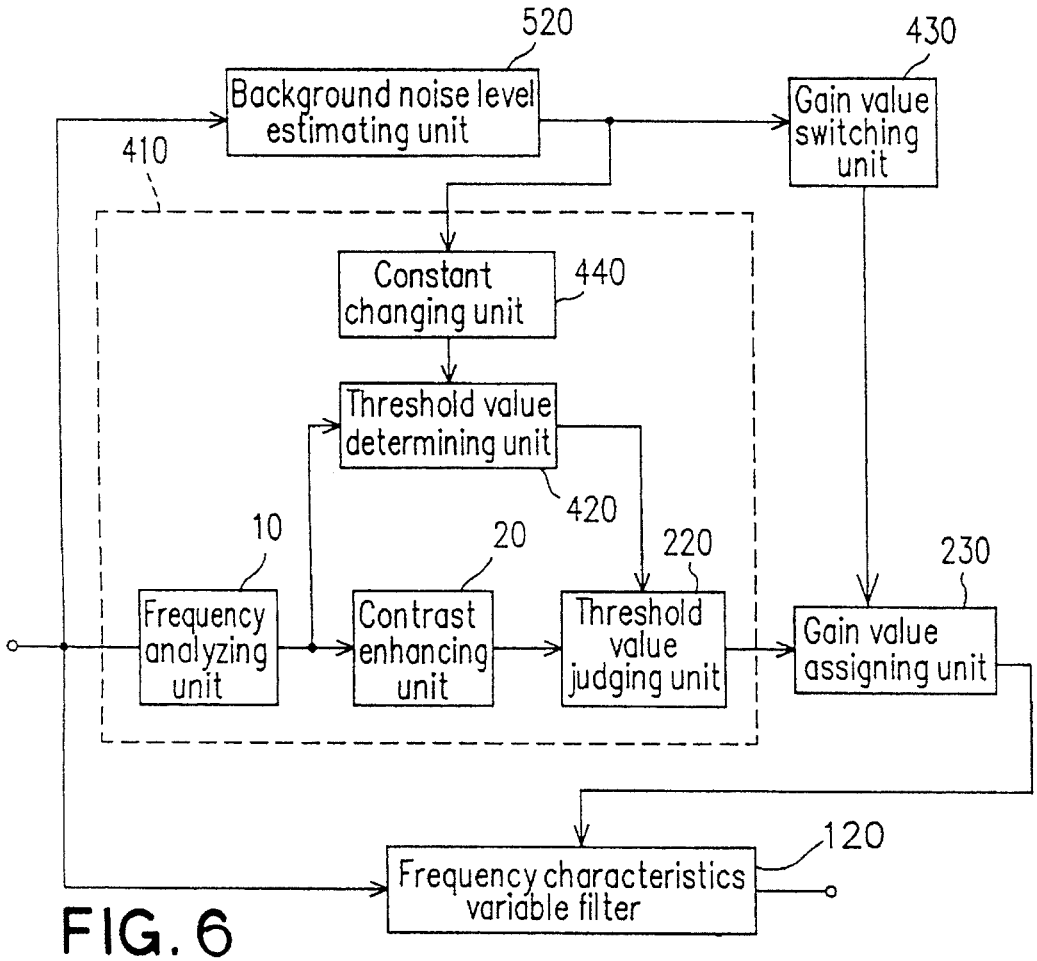
FIG. 6 is a block diagram of a speech processing apparatus of the fifth embodiment according to the present invention.

FIG. 6 shows a construction of a speech processing apparatus according to the fifth embodiment of the present invention. In FIG. 6, the same components as those in FIGS. 1, 5 and 8 are denoted by the same reference numerals as those in FIGS. 1, 5 and 8.

The speech processing apparatus has the formant detecting device 410 for detecting formants from the input speech signal. The speech processing apparatus further has a background noise level estimating unit 520, in addition to the above-mentioned gain value switching unit 430, gain value assigning unit 230 and frequency characteristics variable filter 120.

Next, the operation of speech processing apparatus will be described. The formant detecting device 410 detects formants from the input speech signal. The construction of the formant detecting device 410 is not described in detail, as it has already been discussed regarding the fourth embodiment.

The background noise level estimating unit 520 detects a region solely of background noises, wherein no speech is uttered, and estimates an energy for the background noise in the region. For example, the energy of background noise is estimated by using a noise region estimation based on the maximum likelihood noise estimation method. A simpler method is to divide an input speech signal for dozens of seconds into a plurality of regions, calculate a short-time average value of energy in each region and estimate an energy in the region of minimum short-time average value to be the energy of background noise.

The gain value switching unit 430 stores a plurality of candidate values for a gain value of g to be assigned to the frequency bands other than formants and switches the gain value of g in accordance with an energy level of the noise region estimated by the background noise level estimating unit 520. Namely, the gain value of g is set by the gain value switching unit 430 to a relatively small value if the energy level is high in the estimated noise region, so that differences of energy level between spectral peaks and spectral valleys in the power spectrum are made large. Conversely, in the case of the energy level being low in the estimated noise region, the gain value of g is set by the gain value switching unit 430 to a relatively large value so as to prevent the naturalness of processed speech from being reduced by the modulation of noise. In this way, under noisy circumstances, the difference between the gain value assigned to each formant and the gain value assigned to each frequency band other than the formant is made smaller then the difference under noiseless circumstances. This makes it possible to prevent uncomfortable remaining noises. The value of gain g set by the gain value switching unit 430 is supplied to the gain value assigning unit 230. The operation of gain value assigning unit 230 and the frequency characteristics variable filter 120 is not described in detail here, as they have already been discussed in the second embodiment.

Further, in order to obtain a proper processed speech from various kinds of noisy speech, in the case where a formant detecting device 410 includes the constant changing unit 440, the background noise level estimated by the background noise level estimating unit 520 may be supplied to the constant changing unit 440 as its input. It is assumed that a constant $\alpha$ is a value adjusted similarly to the fourth embodiment, without noise interference. In this case, the constant changing unit 440 changes the constant $\alpha$ set in the threshold value determining unit 420 in accordance with the background noise level. Specifically, the constant changing unit 440 changes the constant $\alpha$ into a larger constant $\beta$ with a rise of background noise level. This is effective for reducing the probability that noise components exceed a threshold value, resulting in a decrease of possibility that the noise components are enhanced erroneously.

As explained hereinbefore, according to the fifth embodiment of the present invention, by changing the gain value to be assigned to the frequency bands corresponding to the valleys in the power spectrum in accordance with the energy level of the estimated noise region, a speech processing apparatus is realized which is effective for preventing deterioration of hearing impression which is caused by distortion of noise, irrespectively of the variation in surrounding noise level.

In the speech processing devices discussed in all of the above embodiments, the gain value to be assigned to each formant by the gain value assigning unit 230 is 1. However, this gain value is not limited to 1, as long as it is larger than the gain value assigned to each frequency band other than formants. Basically, the speech processing apparatus determines the gain values to be assigned so that the monosyllabic articulation and intelligibility is improved. Additionally, it is possible that one value of the gain assigned to a formant is different from another value of the gain assigned to another formant, or that the same value is assigned to all formants.

In the speech processing apparatus of the fourth embodiment, the threshold value determining unit 420 and the gain value switching unit 430 operate independently. Therefore, it is not necessarily required to employ both the threshold value determining unit 420 and the gain value switching unit 430. Further, although the gain value to be assigned to each frequency band other than the formants is switched in the gain value switching unit 430, the gain value to be assigned to each formant also may be switched, and it is possible to switch both of the gain values.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A formant detecting device comprising:

frequency analyzing means for calculating the power spectrum of an input speech signal;

contrast enhancing means for enhancing the contrast between a local maximum portion and a local minimum portion in said power spectrum of said input speech signal; and single threshold value judging means for comparing the power in said power spectrum enhanced by said contrast enhancing means with a threshold value in each frequency band and for judging a frequency band corresponding to said power to be a formant if said power in said enhanced power spectrum exceeds said threshold value.

2. A formant detecting device according to claim 1, wherein said threshold value is predetermined so that a predefined first and a predefined second formant of each of a predetermined number of vocalized vowels are detected by said formant detecting device with probability of 50% or more.

3. A formant detecting device according to claim 1, further comprising threshold determining means for determining said threshold value in accordance with said power spectrum of said input speech signal.

4. A formant detecting device according to claim 3, wherein said threshold value determining means determines said threshold value in each frequency band so that said threshold value is equal to a product of a constant and the power at the corresponding frequency band of said power spectrum of said input speech signal.

5. A formant detecting device according to claim 4, further comprising constant changing means for changing said constant manually.

6. A formant detecting device according to claim 4, further comprising constant changing means for receiving a background noise level and for changing said constant as a function of said background noise level.

7. A formant detecting device according to claim 3, wherein said threshold value determining means determines said threshold value so that said threshold value is equal to the average power over all the frequency bands in said power spectrum of said input speech signal.

8. A formant detecting device comprising:

frequency analyzing means for calculating the power spectrum of an input speech signal;

contrast enhancing means for enhancing the contrast between a local maximum portion and a local minimum portion in said power spectrum of said input speech signal;

dividing means for dividing the power at each frequency band of said power spectrum enhanced by said contrast enhancing means by the power of said input speech signal in the corresponding frequency band;

threshold value judging means for comparing a divisional result obtained by said dividing means with a single threshold value in each frequency band and for judging a frequency band corresponding to said divisional result to be a formant if said divisional result exceeds said threshold value.

9. A speech processing apparatus comprising:

frequency analyzing means for calculating the power spectrum of an input speech signal;

contrast enhancing means for enhancing the contrast between a local maximum portion and a local minimum portion in said power spectrum of said input speech signal;

threshold value judging means for comparing the power in the power spectrum enhanced by the contrast enhancing means with a single threshold value in each frequency band and for judging a frequency band corresponding to said power to be a formant if said power in the enhanced power spectrum exceeds said threshold value;

gain value assigning means for assigning a first gain value to said frequency band judged to be a formant by said threshold judging means and for assigning a second gain value to other frequency bands; and speech signal generating means for generating a speech signal having a power spectrum obtained by multiplying the power at each frequency band of said power spectrum of said input speech signal by the gain value assigned to that frequency band by said gain value assigning means.

10. A speech processing apparatus according to claim 9, wherein said frequency analyzing means further calculates the phase of said input speech signal, and said speech signal generating means further comprises:

multiplying means for multiplying the power at each frequency band of said power spectrum of said input speech signal by the gain value assigned to that frequency band by said gain value assigning means; and inverse transformation means for transforming inversely a multiplicative result obtained by said multiplying means, and said phase of said input speech signal obtained by the frequency analyzing means into the speech signal.

11. A speech processing apparatus according to claim 9, wherein said speech signal generating means comprises frequency characteristics variable filter means for varying frequency characteristics of said input speech signal in accordance with one of said first gain value and said second gain value assigned by said gain value assigning means.

12. A speech processing apparatus according to claim 9, wherein said gain value assigning means has a plurality of candidate values for at least one of said first and second gain values, and said speech processing apparatus further comprises gain value switching means for switching at least one of said first and second gain values to one of said plurality of candidate values.

13. A speech processing apparatus according to claim 9, wherein said gain value assigning means has a plurality of candidate values for at least one of said first and second gain values, and said speech processing apparatus further comprises:

background noise level detecting means for detecting a background noise level from said input speech signal; and gain value switching means for switching at least one of said first and second gain values to one of said plurality of candidate values.

14. A speech processing apparatus comprising:

frequency analyzing means for calculating the power spectrum of an input speech signal;

contrast enhancing means for enhancing the contrast between a local maximum portion and a local minimum portion in said power spectrum of said input speech signal;

dividing means for dividing the power at each frequency band of said power spectrum enhanced by said contrast enhancing means by the power of said input speech signal in the corresponding frequency band;

threshold value judging means for comparing a divisional result obtained by said dividing means with a single threshold value in each frequency band and for judging a frequency band corresponding to said divisional result to be a formant if said divisional result exceeds said threshold value;

gain value assigning means for assigning a first gain value to said frequency band judged to be a formant by said threshold judging means and for assigning a second gain value to other frequency bands; and speech signal generating means for generating a speech signal having a power spectrum obtained by multiplying the power at each frequency band of said power spectrum of said input speech signal by the gain value assigned to that frequency band by said gain value assigning means.

* * * * *